United States Patent [19]

Ito

[11] Patent Number: 4,556,226

[45] Date of Patent: Dec. 3, 1985

[54] WATER-PROOF CONNECTOR

[75] Inventor: Katsuya Ito, Yokkaichi, Japan

[73] Assignee: Tokai Electric Wire Company Limited, Yokkaichi, Japan

[21] Appl. No.: 628,382

[22] Filed: Jul. 6, 1984

[30] Foreign Application Priority Data

Jul. 15, 1983 [JP] Japan ..... 58-110870[U]

[51] Int. Cl.[4] ..... H01R 13/52

[52] U.S. Cl. ..... 277/207 A; 339/60 R

[58] Field of Search ..... 339/59 M, 59 R, 60 R; 277/207 A

[56] References Cited

U.S. PATENT DOCUMENTS

| | | | |
|---|---|---|---|
| 3,937,545 | 2/1976 | Cairns et al. . | |
| 4,097,097 | 6/1978 | Wackenreuther | 277/207 A |
| 4,395,085 | 7/1983 | Inoue . | |
| 4,478,436 | 10/1984 | Hashimoto | 277/207 A |
| 4,482,161 | 11/1984 | Izzi | 277/207 A |

*Primary Examiner*—Robert I. Smith

*Attorney, Agent, or Firm*—Harness, Dickey & Pierce

[57] ABSTRACT

A water-proof connector having a seal ring in the connection between a male connector housing with a male connector and a female connector housing with a female connector is disclosed. An engaging mechanism holds the seal ring on the male connector housing. The insertion or separation of the male connector housing and the female connector housing is facilitated and the water-proof effect is improved.

8 Claims, 13 Drawing Figures

WATER-PROOF CONNECTOR

BACKGROUND OF THE INVENTION

The present invention relates to a water-proof connector or more in particular to a water-proof connector using a water proof seal ring in the coupling of a female connector housing and a male connector housing, or especially an engaging construction of a water-proof seal ring ("O" ring).

Four types of construction of water-proof seal ring engaging constructions shown in FIGS. 1A to 1D are well known for conventional water-proof connectors. In FIG. 1A, a seal ring 3 is fitted on the misalignment 1*b* formed at the forward end 1*a* of a female connector housing 1, a holder 4 for preventing separation of the seal ring 3 is mounted at the forward end 1*a* of the female connector housing, and the female connector housing 1 is coupled with a male connector housing 2. Reference numeral 7 designates a male connector. A female connector is not shown in the drawing.

In FIG. 1B, on the other hand, an annular shot 5 for the seal ring 3 is formed near the forward end 1*a* of a female connector housing 1, and the seal ring 3 is fitted in the annular slot 5.

The construction of the water-proof connector shown in FIG. 1C is such that a seal ring 3 is fitted in a recess 6 at the last half portion 2*b* of a male connector housing 2, the first half portion 2*a* of the male connector housing 2 doubling as a member for preventing separation of the seal ring 3 is brought into contact with the seal ring 3, and the outer peripheries of the first and second half portions are welded to each other thereby to fixedly engage the seal ring 3.

The water-proof connector of FIG. 1D is so constructed that an annular engaging protrusion 8 is formed in the recess 6 of the male housing 2, and a seal ring 3 is fixedly fitted between the bottom and the engaging protrusion 8 of the recess 6.

The above-described conventional engaging constructions have the disadvantages mentioned below respectively.

The construction of FIG. 1A requires a considerable number of parts the others resulting in a high cost and involves more steps due to the requirement of the holder to be fixed by welding or like means. In the construction of FIG. 1B, the annular slot 5 is required to be molded integrally with the female housing 1 by use of a couple of vertically-split dies, which unavoidably causes a burr along the part line separating the upper and lower dies, thus deteriorating the seal ring performance. The water-proof connector of FIG. 1C is bulkier than those of FIG. 1A or 1B, and also, because of the requirement of welding equipment such as ultrasonic welder, is impractically high in cost. Lastly, in the construction of FIG. 1D, the height of the engaging protrusion 8 is limited to 0.3 to 0.5 mm for processing reasons, so that the seal ring 3 is liable to come off during transportation on the one hand and upon mounting or demounting of the female connector housing 1 the seal ring 3 is sometimes reversed and peeled or separated off by the fitting or separation resistance respectively. Further, the seal rings 3 of the constructions of FIGS. 1A and 1B an fitted exposed on the outer periphery, and therefore is often damaged in constant with other members. In the constructions of FIGS. 1C and 1D, by contrast, in spite of the advantage of the seal ring 3 being built in and protected from damage, the seal ring 3 cannot be visually identified from outside.

SUMMARY OF THE INVENTION

Accordingly, it is an object of the present invention to provide a water-proof connector which comprises a fewer number of parts and has a high sealing effect to obviate the shortcomings of the conventional water-proof connector constructions.

Another object of the present invention is to provide a water-proof connector in which the connector housings are mutually easily fitted or separated while holding the water-proof seal ring effectively in position.

Still another object of the present invention is to provide a water-proof connector in which any damage of the seal ring can be prevented and the seal ring can be easily identified.

According to the present invention, there is provided a water-proof connector comprising a seal ring used in the coupling between a male connector housing with a male connector unit and a female connector housing with a female connector unit, wherein an engaging means is formed for holding the seal ring on the male connector housing, and the seal ring is pressed by the coupling of the male connector housing and the female connector housing thereby to achieve a water-proofing effect.

DESCRIPTION OF THE PREFERRED EMBODIMENTS

Figure 1A:
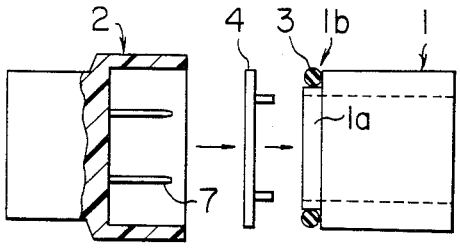
FIG. 1A PRIOR ART
FIGS. 1A to 1D are sectional views of conventional water-proof connector constructions.
Figure 1B:
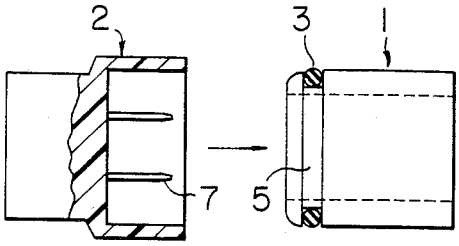
FIG. 1B PRIOR ART
Figure 1C:
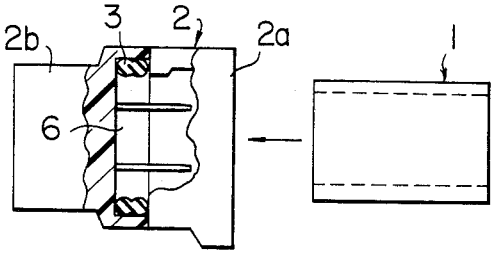
FIG. 1C PRIOR ART
Figure 1D:
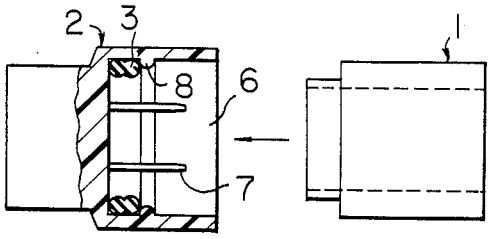
FIG. 1D PRIOR ART
Figure 2:
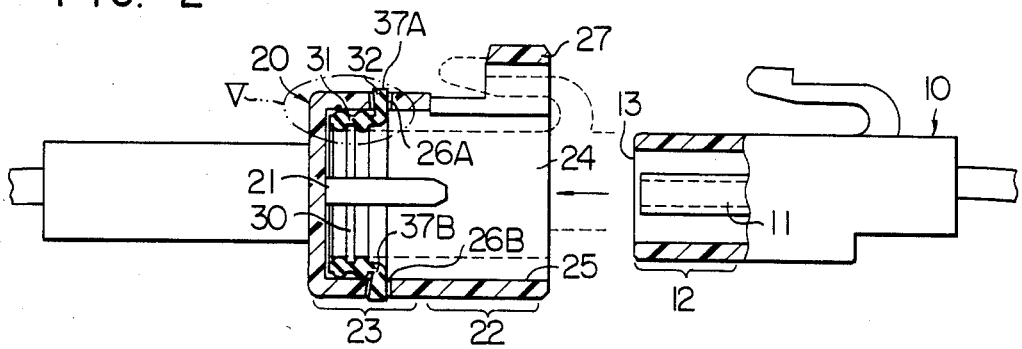
FIG. 2 is a sectional view of a water-proof connector according to a first embodiment of the present invention.

Embodiments of the present invention will be described with reference to the drawings. FIG. 2 is a diagram generally showing a water-proof connector according to a first embodiment of the present invention. Reference numeral 10 designates a female connector housing, numeral 11 a female connector unit, numeral 20 a male connector housing, and numeral 21 a male connector unit. Numeral 30 designates a seal ring. In this drawing, the seal ring 30 is mounted on the male connector housing 20, while the female connector housing 10 is not mounted thereon.

The various parts of the connector will be explained. Numeral 12 designates the first half portion of the female connector housing 10, and numeral 13 the forward end thereof. Numeral 22 designates the first half portion of the male connector housing, and numeral 23 the rear end thereof. In similar fashion, numeral 24 is defined as a recess of the male connector housing, and numeral 25 as a peripheral wall thereof. Numeral 31 designates a cylindrical body of the seal ring, and numeral 32 an engaging portion.

Figure 3A:
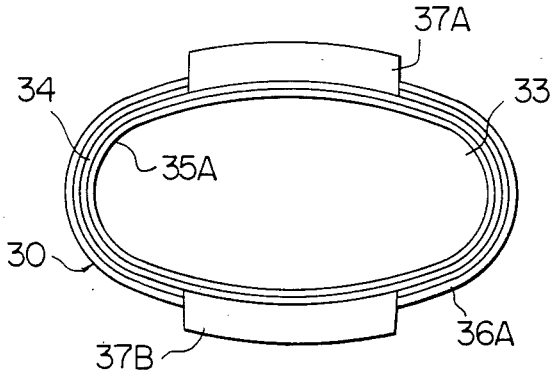
FIG. 3A is a front view of a seal ring used in the above embodiment, FIG. 3B a plan view, and FIG. 3C a side view of the same seal ring.
Figure 3B:
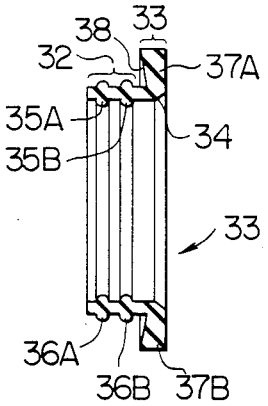
Figure 3C:
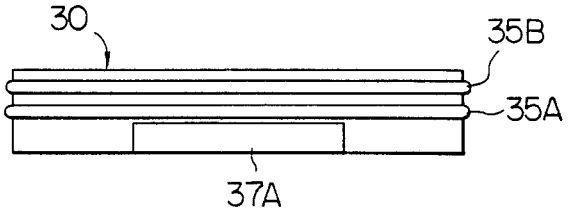

FIGS. 3A to 3C show details of the seal ring 30. The seal ring 30 includes a cylindrical portion 31 formed on a turbular rubber ring with a through hole 33 to be fitted on the body of the female connector housing 10, and an engaging portion 32. The internal rear end of the engaging portion 32 is formed with a cup-shaped taper 34 for guiding the female connector housing 10 as the latter is inserted. The inner surface of the cylindrical member 32 is provided with annular protrusions 35A, 35B adapted to be pressed hermetically against the body of the female connector housing 10. In similar manner, the exterior surface of the cylindrical portion 32 is formed with annular protrusions 36A, 36B adapted to be hermetically sealed against the peripheral wall 25 of the recess 24 of the male connector housing 20.

A pair of engaging protrusions 37A, 37B are formed over a certain length along the outer periphery of the engaging portion 33 of the seal ring 30. The engaging protrusions 37A, 37B are engaged with the seal ring stop hole stopper shots 26A, 26B of the male connector housing 20, and are provided for the purpose of holding the seal ring 30 in position. The side portion 38 of the engaging portion 33, as shown in FIG. 5, forms a slope of outwardly progressive greater thicknesses along the gradient of the seal ring stopper slot 26A as explained later.

Figure 4A:
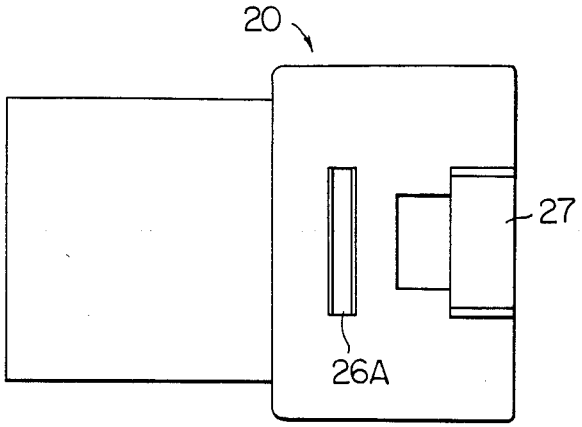
FIG. 4A is a front view, FIG. 4B a plan view and FIG. 4C a side view of a male connector housing of the same embodiment.
Figure 4B:
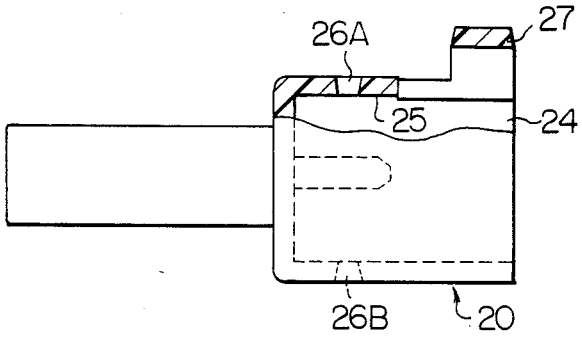
Figure 4C:
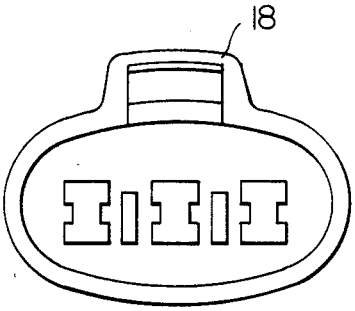

The male connector hosuing 20 is illustrated in detail in FIGS. 4A to 4C. Ring stopper slots 26A, 26B for engagement with the engaging protrusions 37A, 37B are formed on the peripheral wall 25 of the recess 24 at the rear end 23 of the male connector housing 20 in order to receive the first half portion 12 of the female connector housing 10. The inner wall of the seal ring stopper slots 26A, 26B is progressively outwardly widened (at gradient angle $\theta$ of about 10 degree) in such a manner as to form a sharp edge of the coupling rims 26A', 26B' between the seal ring stopper slots 26A, 26B and the peripheral wall 25. Numeral 27 in the drawing designates an engaging portion for having the female and male connector housings 10 and 20 engaged in coupled position.

The functions of the first embodiment will be explained. A water-proof connector comprising an engaging mechanism including the engaging protrusions 37A, 37B of the seal ring 30 and seal ring stopper slots 26A, 26B of the male connector hosuing 27 is used as mentioned below.

Figure 5:
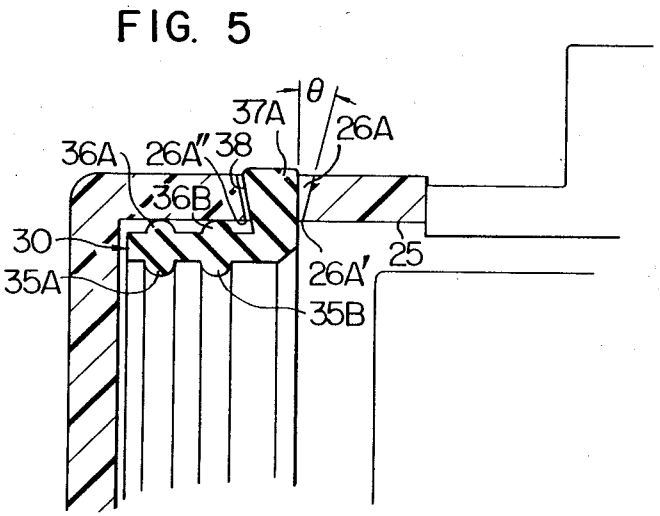
FIG. 5 is a diagrma showing, partially enlarged, the coupling of the male connector housing and the seal ring.

With reference to FIGS. 2 and 5, the seal ring 30 is fitted in advance in the recess 24 of the male connector housing 20 so that the engaging protrusions 37A, 37B are fitted in the seal ring stopper slots 26A, 26B thereby to keep the seal ring 30 engaged in the recess 24. The female connector housing 10 is then inserted from the first half portion 22, that is, the inlet of the recess 24. The female connector housing 10, guided by the taper 34 of the seal ring 30 fitted already, is fitted on the seal ring 30. The male connector unit 21 of the male connector housing 20 is coupled with the female connector unit 11 in the female connector housing 10. The female connector housing thus inserted is pressed against the annular protrusions 35A, 35B on the inner surface of the seal ring 30. The peripheral wall 25 of the recess 24 of the male connector housing 20, on the other hand, is pressed against the annular protrusions 36A, 36B on the outer periphery of the seal ring 30, both being hermetically pressed to secure the sealing performance of the particular portions.

In the water-proof connector according to this embodiment, which has an engaging mechanism of the above-mentioned construction, the seal ring 30 inserted occupies a very stable position. At the time of insertion or separation of the female connector housing 10, the sharp edges of the coupling rims 26A', 26A'', 26B', 26B'' of the seal ring stopper slots 26A, 26B slightly bite into the base of the engaging protrusions 37A, 37B thereby to increase the resistance, hence, the engaging force. As a result, the seal ring 30 is prevented from coming off or the cylindrical portion of the seal ring 30 is prevented from reversing out of position, and therefore these parts are kept in position thereby to improve the stability of the sealing function.

In the water-proof connector according to the embodiment under consideration, the water-proof connector is simple in construction and the seal ring 30 thereof can be easily mounted or demounted. Further, it is low in cost and easy to operate, with the seal ring 30 built in for protection from external damage. Furthermore, visual identification of the seal ring 30 is possible through the seal ring stopper slots 26A, 26B, thus preventing the seal ring 30 from being left fitted or a faulty seal ring from being produced.

Figure 6:
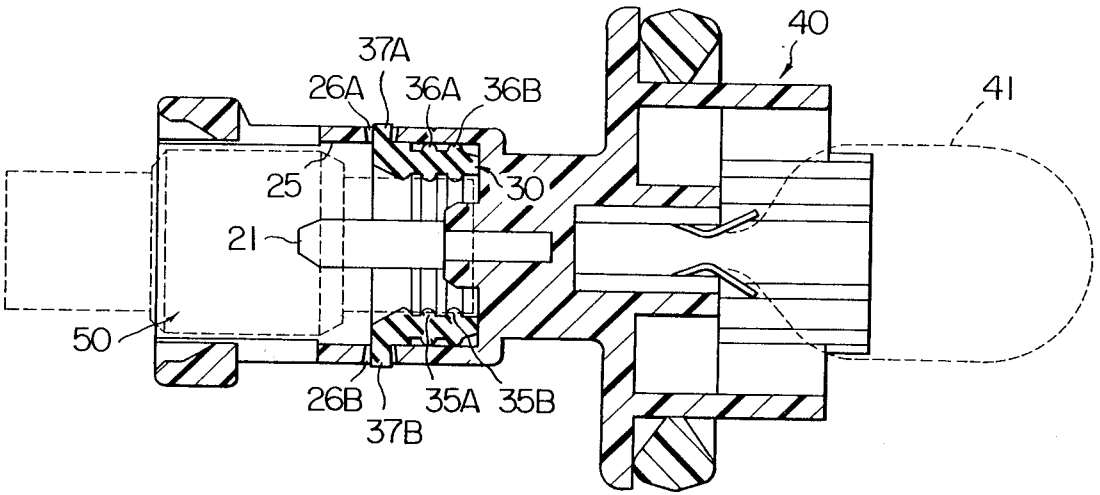
FIG. 6 is a sectional view showing a general configuration of a second embodiment of the present invention.

A second embodiment of the present invention is shown in FIG. 6, in which the male connection housing makes up a lamp socket 40. A seal ring 30 having the same annular protrusions 35A, 35B, 36A, 36B and engaging protrusions 37A, 37B as in the first embodiment are fitted in a bottom recess of the male connector hosuing 60 for receiving the female connector housing 50. The engaging protrusions 37A, 37B are adapted for engagement with the seal ring stopper slots 26A, 26B respectively formed on the peripheral wall 25 of the male connector housing 20, thereby making up an engaging mechanism similar to that of the first embodiment. The above-mentioned lamp socket 40 has the same effect and functions as the female connector unit of the first embodiment. Numeral 41 in the drawing designates a lamp.

Although a seal ring 30 of rubber is used for explanation of the above-mentioned embodiments, any other material which is subject to deformation under pressure may alternatively be used with equal effect.

According to the invention, there are desirably arranged a copule of engaging protrusions 37A, 37B symmetrically with each other for stabilization of the seal ring. Depending on the circumstances, however, three or more engaging protrusions may be used.

I claim:

1. A water-proof connector comprising a seal ring in the coupling between a first connector housing with a first connector and a second connector housing with a second connector, said second connector housing defining an opening adapted to receive a corresponding shaped projection formed on said first connector housing wherein said seal ring includes a cylindrical portion and an engaging portion, said cylindrical portion including annular protrusions, said engaging portion including at least two engaging protrusions, seal ring stopper slots extending through said second connector housing from its outer surface and terminating within said opening for engaging and retaining said engaging protrusions of said seal ring in the peripheral wall of said first connector housing, said engaging protrusions of said seal ring being sealingly engaged with said projection of said first connector housing while said first connector housing is inserted into said second connector housing, thereby pressing said annular protrusions of said seal ring for water-proofing purpose.

2. A water-proof connector according to claim 1, wherein said engaging portion of said seal ring has its engaging protrusions formed with a sloped surface of progressively increased thickness in an outward direction.

3. A water-proof connector according to claim 1, further comprising the second connector housing forming a sharp edge at the inner termination of said seal ring stopper slots for biting engagement with said seal ring engaging protrusions.

4. A water-proof connector according to claim 1, wherein said seal ring is formed of a material subject to deformation under pressure.

5. A water-proof connector according to claim 4, wherein said seal ring is formed of rubber.

6. A water-proof connector according to claim 1, wherein one of said connector housings is coupled with a lamp socket.

7. A water-proof connector according to claim 1, wherein the first connector has a plurality of circumferential grooves formed in its projection, the seal ring annular protrusions being complementary to and engaged with said grooves for forming a seal therewith.

8. A water-proof connector according to claim 1, wherein the engaging protrusions of the seal ring and the seal ring stopper slots of the second connector housing are tapered in an outward direction for forming a seal between the second connector housing and the seal ring engaging protrusions upon insertion of the first connector housing into the second connector housing.

* * * * *